US005742015A

United States Patent [19]

Moldovan et al.

[11] Patent Number: 5,742,015

[45] Date of Patent: Apr. 21, 1998

[54] ELECTRIC CURRENT SWITCHING APPARATUS WITH UNITIZED REMOVABLE CONTACTS

[75] Inventors: Peter K. Moldovan, Cascade; Michael E. Bauer, Hartland; Stephen R. Fiacchino, Saukville; Earl T. Piber, Oconomowoc; Brad L. Myers, Milwaukee; Kurt D. Matschull, Greendale, all of Wis.

[73] Assignee: Eaton Corporation, Milwaukee, Wis.

[21] Appl. No.: 726,991

[22] Filed: Oct. 7, 1996

[51] Int. Cl.[6] ..... H01H 33/00

[52] U.S. Cl. ..... 218/1

[58] Field of Search ..... 218/1, 8, 15, 151, 218/148, 36, 40; 200/293

[56] References Cited

U.S. PATENT DOCUMENTS

| | | | |
|---|---|---|---|
| 4,006,440 | 2/1977 | Burton et al. | 335/132 |
| 4,525,694 | 6/1985 | Dennison et al. | 335/132 |
| 4,760,364 | 7/1988 | Ostby | 335/132 |
| 4,766,273 | 8/1988 | Butterworth et al. | 218/40 |
| 5,004,874 | 4/1991 | Theisen et al. | 218/151 |
| 5,416,455 | 5/1995 | Moldovan et al. | 335/132 |

*Primary Examiner*—Adolf Berhane
*Attorney, Agent, or Firm*—Quarles & Brady

[57] ABSTRACT

A sealed contactor for switching electric current has a switching assembly that includes a movable contact which selectively bridges a pair of stationary contacts to provide an electrical path therebetween. The moveable and stationary contacts are mounted to a body of electrically insulating material to form a unitized structure. A separate actuator assembly has an enclosure which contains an electrically operated driver with a linkage that extends into the switching assembly to alternately operate the moveable contact into engagement with and disengagement from the stationary contacts. The switching assembly is sealingly attached to the actuator assembly in an interlocking manner that prevents arcs produced between the contacts from escaping outside the electric current switching apparatus. Nevertheless, the switching assembly is capable of being easily removed and replaced as a single unit from the actuator assembly when repairing the contactor.

19 Claims, 4 Drawing Sheets

ELECTRIC CURRENT SWITCHING APPARATUS WITH UNITIZED REMOVABLE CONTACTS

BACKGROUND OF THE INVENTION

This invention relates to apparatus for switching electric current; and more particularly to such apparatus which have replaceable contact components.

Contactors and other types of switching devices usually are provided between a power source and a load to apply and remove electric current to the load. These devices utilize one or more pairs of contacts which come together to complete the electric circuit between the power source and the load and which separate to open that circuit. Many applications require the switching of relatively large currents, which produce arcs when the contacts separate. As a result, mechanisms for extinguishing the arcs are provided within the contactor enclosure and in some instances, the contactors have a sealed enclosure so that these arcs do not escape to the exterior where injury could result.

The arcs which occur between the pairs of contacts erode the surfaces of the switch contacts. Over time with repeated operations of the contactor, the contacts become pitted to the extent that their surfaces do not abut in a sufficiently large enough area to provide an adequate path for the electric current. In this case, the contacts must be replaced. However, because the contacts are within the sealed enclosure, a technician in the field may not be able to gain access to the contacts. As a consequence, the entire switching device must be replaced.

SUMMARY OF THE INVENTION

A general object of the present invention is to provide an improved switching apparatus for electric current.

Another object is to provide a current switching apparatus which has a sealed enclosure to prevent electrical arcs from escaping to outside the apparatus.

A further object of the present invention is to provide the sealed current switching apparatus with replaceable switch contacts.

Yet another object is to incorporate the switch contacts into a unitized subassembly which can be removed as a single unit from the remainder of the apparatus and replaced. This not only facilitates replacement of the switch contacts in the field, but enables continuing use of the remainder of the switching apparatus which does not require replacement.

These and other objects are fulfilled by an electric current switch that has a switching assembly removably attached to an actuator assembly. The switching assembly includes a body of electrically insulating material to which first and second stationary contacts are mounted. A movable contact is coupled to the body and is able to move to selectively engage the first and second stationary contacts to complete an electrical current path therebetween.

An actuator assembly encloses an electrically operated driver, such as a solenoid, that has a linkage releasably coupled to the moveable contact. Activation of the driver operates the moveable contact alternately into engagement with and disengagement from the first and second stationary contacts. The switching assembly is attached to the actuator assembly in an interlocking manner that prevents arcs produced between the contacts from escaping outside the electric current switching apparatus. The interlocking attachment enables the switching assembly to be removable as a single unit from the actuator assembly for repair and replacement.

DETAILED DESCRIPTION OF THE INVENTION

Figure 1:
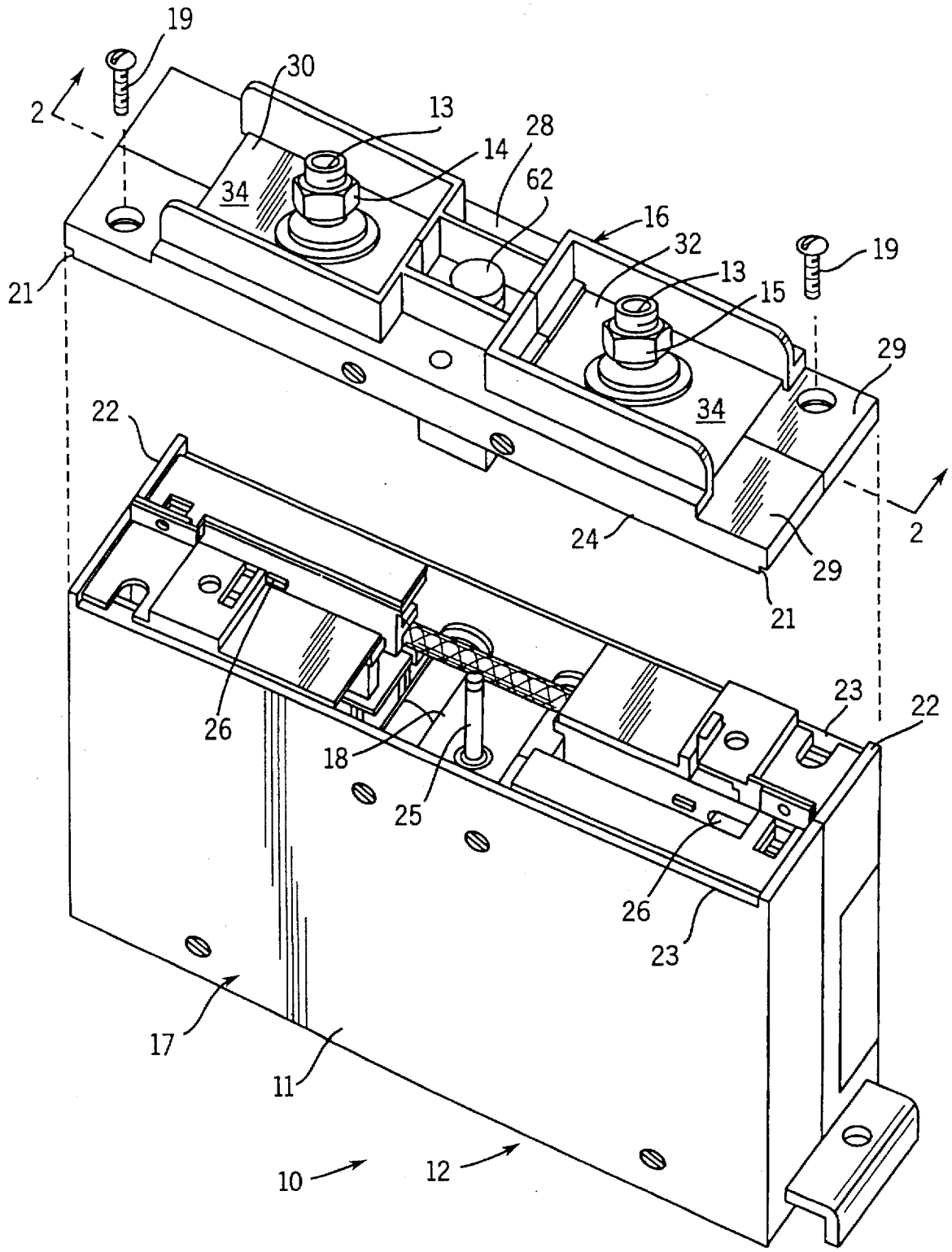
FIG. 1 is an exploded view of a contactor with unitized, replaceable switch contacts according to the present invention.
Figure 2:
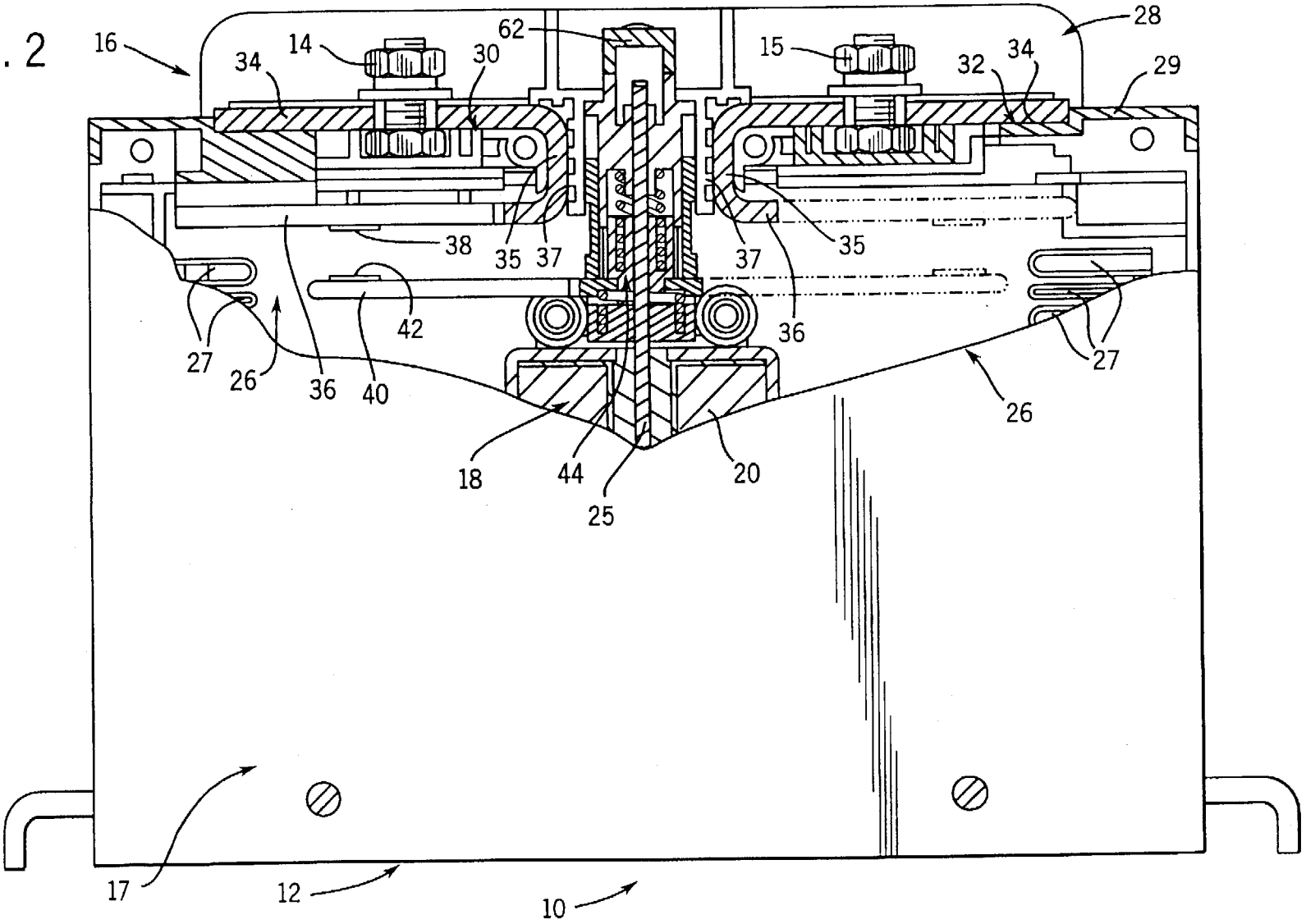
FIG. 2 is a partial cut-away, cross-sectional view of the assembled contactor.

With reference to FIG. 1, a sealed electromagnetic single-pole contactor 10 has a housing 12 which is formed by a switching assembly 16 that nests against an open side of an actuator portion 17 as shown in FIG. 2. The short sides of the switching assembly 16 have longitudinal recesses 21 which receive and mate with lips 22 along the short sides of the actuator portion 17 of housing 12. Similarly, the long sides of the housing actuator portion 17 have longitudinal recesses 23 which receive and mate with lips 24 along the long sides of the switching assembly 16. Alternatively, all the sides of one of the switching assembly 16 or the actuator portion 17 can have the lips with all the sides of the other component having the mating recesses. The engagement of the lips 22 and 24 into recesses 21 and 23 provide a sealed interface between the actuator portion and the switching assembly 16 which prevents electrical arcs occurring within the contactor from escaping the housing 12. The switching assembly 16 is held in place covering the open side of the actuator portion 17 by machine screws 19 and subsequently may be detached therefrom as a single unit by removing those machine screws.

As illustrated in FIGS. 1 and 2, the actuator portion 17 has an enclosure 11 of electrically insulating material, such as plastic, which contains conventional components for opening and closing switch contacts of the contactor 10. These components include an electromagnetic solenoid 18 which nests in recesses in the interior surfaces of the actuator enclosure 11. The solenoid 18 has an annular coil 20 which drives an armature connected to a shaft 25 that projects from one end of the solenoid. Arc extinguishing chambers 26 are disposed on opposite sides of the solenoid 18. Each arc extinguishing chamber 26 is comprised of a plurality of spaced apart, metal splitter plates 27.

Figure 3:
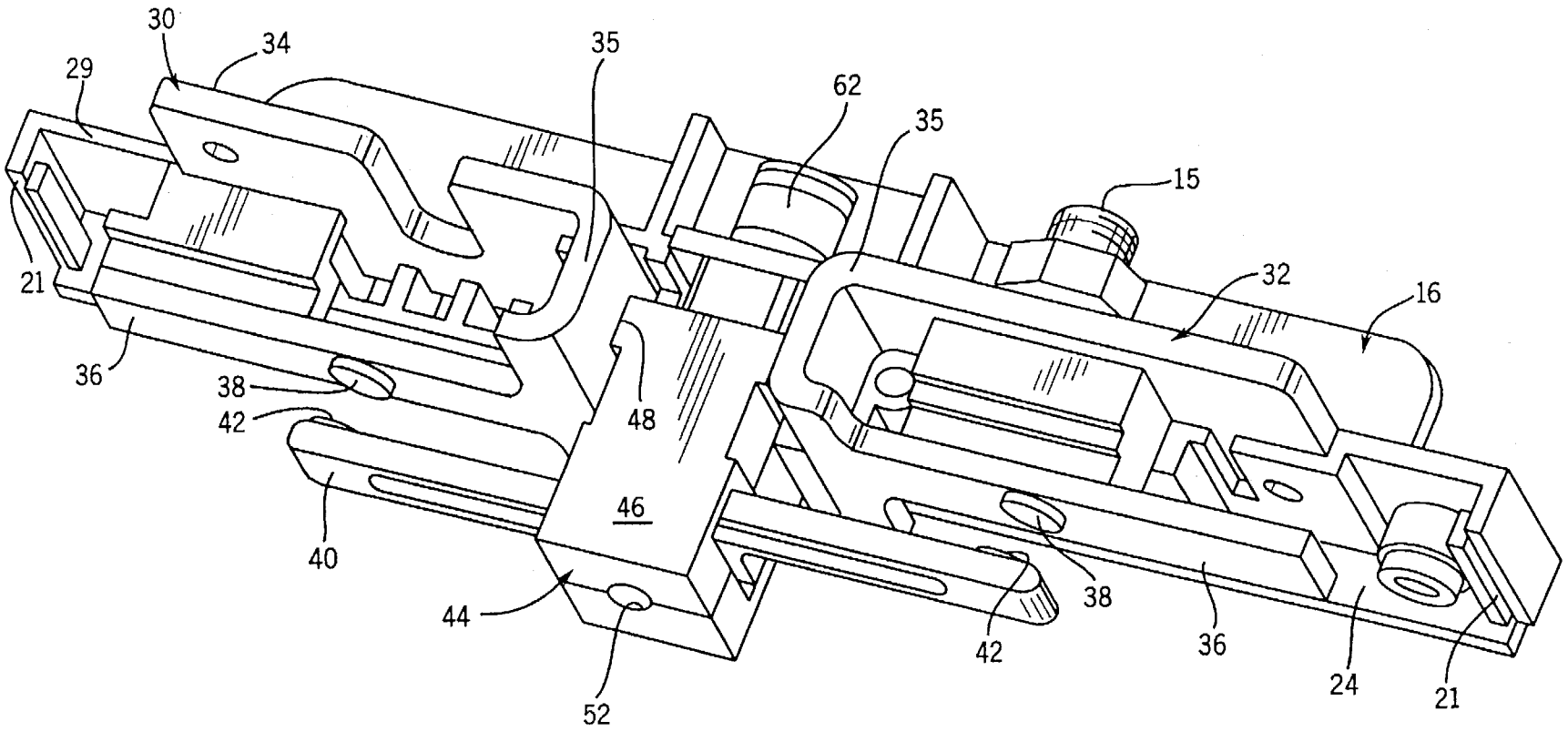
FIG. 3 is an isometric view of the replaceable switch contact assembly.

With particular reference to FIG. 2, the switching assembly 16 has a body 28 formed by two halves 29 of electrically insulating material, such as plastic. The switching assembly 16 includes first and second power terminals 14 and 15 which are connected to first and second stationary contacts 30 and 32, respectively. As shown in detail in FIG. 3, each metal stationary contact 30 and 32 is U-shaped with one long leg 34 being exposed through an opening in the surface of the switching assembly 16. Each stationary contact 30 and 32 has a short leg 35 which bends into the housing 12 and tightly abuts sealing surfaces 37 so that gaps do not exist between the stationary contacts and the entrance into the housing. This abutting relationship prevents arcs produced within the housing from escaping along the stationary contacts 30 and 32. Another long leg 36 of each stationary contact 30 and 32 is entirely within the housing 12 and has a contact pad 38 mounted thereon. It can be seen in FIG. 3 that these other legs 36 are narrower than outer legs 34 and are oppositely offset in the short dimension of the housing.

An electrically conductive, moveable contact 40 is part of the switching assembly 16 and has a pair of contact pads 42 which face the contacts pads 38 on the stationary contacts 30 and 32. The opposite legs of moveable contact 40 are offset correspondingly to the offset of legs 36 of stationary contacts 30 and 32. In the closed state of the contactor 10, the moveable contact 40 bridges the two stationary contacts 30 and 32 completing a path for electric current to flow between the power terminals 14 and 15. A spring mechanism 44 biases the moveable contact 40 so that the contactor 10 is in a normally open position when the solenoid coil 20 is deenergized, as illustrated in FIG. 2.

Figure 4:
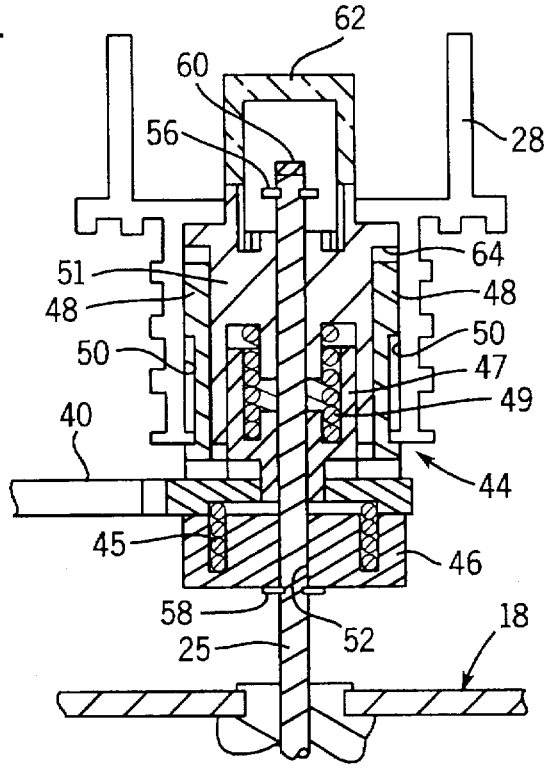
FIG. 4 is an isolated cross-sectional view of the spring mechanism coupled to a moveable contact in the closed state of the contactor.

As shown in FIGS. 2 and 4, the spring mechanism 44 includes a hollow, insulating retainer 46 which has a pair of ears 48 on opposites sides that are held within grooves 50 in the switching assembly body 28 to secure the spring mechanism thereto. The ears 48 slide within the grooves 50 as the contacts 30, 32 and 40 open and close with the groove limiting the movement of the moveable contact 40 and thereby the gap formed between contact pads 38 and 42 when the contactor 10 is in the open state. Specifically the moveable contact 40 passes through apertures in the sides of the retainer 46 with a first spring 45 biasing one side of the moveable contact 40 away from a closed end of the retainer 46. An insulating plunger 47 abuts the opposite side of the moveable contact 40 and is biased with respect to an insulating piston 51 into that abutting relationship by a second spring 49. The plunger 47 and piston 51 are located within the retainer 46 with a portion of the piston projecting from an open end of the retainer 46 and extending through an aperture in the body 28 of the switching assembly 16. A transparent cap 62 fits onto this portion of the piston 51.

The retainer 46 and other components of the spring mechanism 44 have an aperture 52 through which the shaft 25 of the solenoid 18 extends when the two portions 16 and 17 of the housing 12 are assembled, as shown in FIG. 4. Snap rings or spring clips 56 and 58 fit into circumferential grooves in the shaft 25 respectively above and below the spring mechanism 44 so that the spring mechanism is captivated to move with the shaft.

A colored indicator disk 60 is attached to the end of the solenoid shaft 25 and is visible from outside the housing through the transparent cap 62 when the contacts 30, 32 and 40 are in the closed state. In that state, the moveable contact 40 strikes the stationary contacts 30 and 32 before the solenoid shaft 25 reaches the end of its travel. Continued movement of the shaft 25 pushes the retainer 46 further upward in FIG. 4 while the moveable contact 40 remains stationary. That action causes the first spring 45 to compress and provides self adjustment which compensates for wear of the contact pads 38 and 42 over time.

Figure 5:
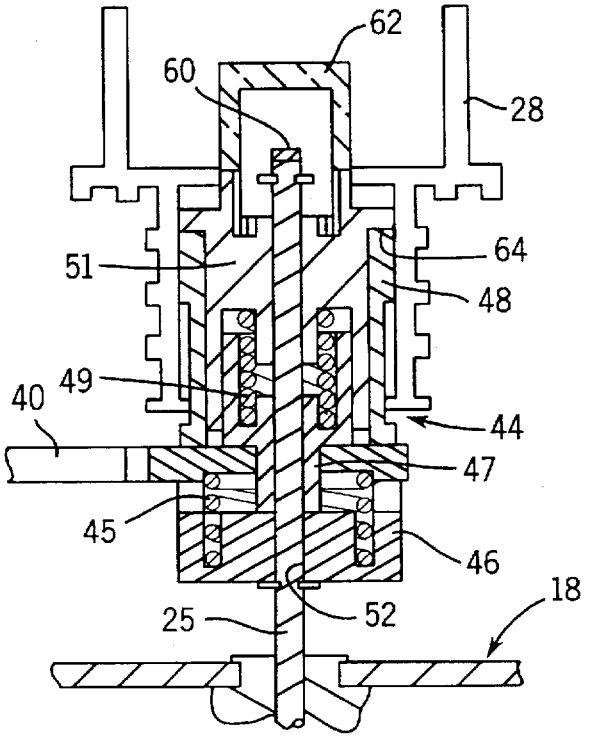
FIG. 5 is an isolated cross-sectional view of the spring mechanism in the state which occurs when welded switch contacts are being manually broken apart.

When relatively large currents are being switched, it is possible for the contact pads 42 on the moveable contact 40 to become stuck, or welded, to the contact pads 38 on one or both of the stationary contacts 30 and 32 and the force of second spring 49 may be insufficient to break the contacts apart. When this occurs, the spring mechanism 44 is held in the position illustrated in FIG. 4. In this circumstance, a technician is able to press the cap 62 against the spring mechanism 44 and into the housing 12. That action pushes the piston 51 so that its shoulder 64 interacts with retainer 46 causing the retainer to strike the moveable contact 40 as shown in FIG. 5. This exerts force in a direction that tends to move the moveable contact away from the stationary contacts 30 and 32 thereby breaking the weld.

As noted previously, electrical arcing between the movable contact 40 and the two stationary contacts 30 and 32 erodes the contact pads 38 and 42 through which the current flows when the contactor 10 is in the closed state. Excessive erosion reduces the area of contact between abutting pads 38 and 40 thereby increasing resistance to the current flow and generating heat. Therefore, the temperature of the stationary contacts 30 and 32 provides an indication of the degree of contact pad wear and erosion. Thermal indicators 13 are applied to exposed ends of the first and second power terminals 14 and 15 respectively, as seen in FIG. 1. For example, the thermal indicators 13 may be a temperature sensitive dot, such as "Single-Point Indicators" marketed by Cole-Parker Instrument Company of Niles Ill. U.S.A. Alternatively, the temperature sensitive dot 13 can be applied to the exposed surface of one or both of the stationary contacts 30 and 32. The temperature sensitive dot 13 changes color upon reaching a predefined temperature which results from excessive wear of the contact pads 38 and 42. For example, the power terminals have been found to reach a temperature of 150° C. in the closed state of a contactor 10 with excessively worn contact pads. Because contact temperature is related to current density at the contact pads and the contact pads become larger in contactors with greater current capacity to maintain the current density about the same, the wear indication temperature should be approximately the same regardless of the current rating of the contactor. Other types of thermal indicators may be incorporated into one or both of the power terminals 14 and 15. For example, a device with a spring loaded indicator retained by eutectic alloy solder that melts at the designated temperature may be utilized.

When excessive contact pad wear or erosion is indicated, the switch contacts 30, 32 and 40 can be replaced. To perform that replacement, the cables attached to the power terminals 14 and 15 are disconnected. Then machine screws 19 on the housing 12 are removed and the spring clip 56 at the end of the solenoid shaft 25 is detached upon gaining access by pulling off cap 62. After the removal of these fastening devices, the switching assembly 16 can be pulled away from the actuator portion 17 as depicted in FIG. 1. A new switching assembly 16 then is placed onto the existing actuator portion 17 and the fasteners 19 and 56 reattached. Because the stationary contacts 30 and 32 and the moveable contact 40 are replaced as a single unit, the technician performing the replacement does not have to set the gap between the contact pads 38 and 42, as this gap is set at the factory during assembly of the switching assembly 16.

The foregoing description is directed primarily to preferred embodiments of the invention. Although some attention was given to various alternatives within the scope of the invention, it is anticipated that skilled artisans will likely realize additional alternatives that are now apparent from the disclosure of those embodiments. For example, the inventive concepts may be incorporated into other types of electrical switching devices than the illustrated contactor. Accordingly, the scope of the invention should be determined from the following claims and not limited by the above disclosure.

We claim:

1. An electric current switching apparatus comprising:

a switching assembly having a body of electrically insulating material, first and second stationary contacts mounted to the body, a movable contact movably coupled to the body and selectively engaging the first and second stationary contacts to complete electrical connection therebetween; and an actuator assembly having an enclosure to which is attached an electrically operated driver that includes a member releasably attached to the moveable contact for alternately operating the moveable contact into engagement and disengagement with the first and second stationary contacts;

wherein the switching assembly is sealingly attached to the actuator assembly to prevent arcs produced between the moveable contact and the first and second stationary contacts from escaping outside the electric current switching apparatus, with the switching assembly being removable as a single unit from the actuator assembly for repair and replacement.

2. The electric current switching apparatus as recited in claim 1 wherein the actuator assembly further comprises an arc extinguishing chamber having a plurality of splitter plates adjacent to the movable contact.

3. The electric current switching apparatus as recited in claim 1 wherein the switching assembly has a predefined gap between the moveable contact and each of the first and second stationary contacts.

4. The electric current switching apparatus as recited in claim 1 wherein the enclosure of the actuator assembly has a lip which is received into a recess in the body of the switching assembly to provide an arc barrier at an interface between the actuator assembly and the switching assembly.

5. The electric current switching apparatus as recited in claim 1 wherein the body of the switching assembly has a lip which is received into a recess in the enclosure of the actuator assembly to provide an arc barrier at an interface between the actuator assembly and the switching assembly.

6. The electric current switching apparatus as recited in claim 1 wherein the moveable contact is coupled to the member of the actuator assembly by a spring mechanism which allows movement of the moveable contact to compensate for wear of the moveable contact and the first and second stationary contacts.

7. The electric current switching apparatus as recited in claim 1 wherein the moveable contact is coupled to the body of the switching assembly by a spring mechanism comprising:

a retainer slidably coupled to the body and having an aperture through which the moveable contact is received, the member of the actuator assembly engaging the retainer; and a spring biasing the moveable contact with respect to the retainer.

8. The electric current switching apparatus as recited in claim 7 further comprising an operator that engages the retainer and being manually operable to force the moveable contact away from the first and second stationary contacts.

9. The electric current switching apparatus as recited in claim 1 wherein the moveable contact is coupled to the body of the switching assembly by a spring mechanism comprising:

a retainer slidably coupled to the body, and having an open end, a closed end and an aperture through which the moveable contact is received;

a first spring biasing the moveable contact with respect to the closed end of the retainer;

a plunger within the retainer on a side of the moveable contact remote from the close end, and having a portion which extends through an aperture in the moveable contact and which abuts the closed end of the retainer;

a piston within the retainer and projecting from the open end; and a second spring biasing the plunger away from the piston.

10. The electric current switching apparatus as recited in claim 1 further comprising an indicator of a position of the moveable contact, wherein the indicator is visible from outside the switching assembly.

11. The electric current switching apparatus as recited in claim 10 wherein the indicator indicates when the moveable contact abuts the first and second stationary contacts.

12. The electric current switching apparatus as recited in claim 1 further comprising a thermal indicator attached to the first stationary contact.

13. The electric current switching apparatus as recited in claim 1 further comprising a thermal indicator attached to the first stationary contact wherein the thermal indicator changes color at a predefined temperature.

14. The electric current switching apparatus as recited in claim 1 further comprising a thermal indicator attached to the first stationary contact wherein the thermal indicator changes color at a predefined temperature which indicates excessive wear of at least one of the moveable contact and the first and second stationary contacts.

15. An electric current switching apparatus comprising:

a housing of electrically insulating material;

first and second stationary contacts attached to the housing;

a movable contact which selectively engages the first and second stationary contacts to complete an electrical circuit;

an actuator coupled to the moveable contact for driving the movable contact into and out of engagement with the first and second stationary contacts; and a thermal indicator attached to the first stationary contact and indicating when the first stationary contact reaches a temperature that occurs when at least one of the moveable contact and the first and second stationary contacts has become excessively worn.

16. The electric current switching apparatus as recited in claim 15 wherein the thermal indicator changes color at a predefined temperature.

17. An electric current switching apparatus comprising:

a housing of electrically insulating material;

first and second stationary contacts attached to the housing;

a movable contact which selectively engages the first and second stationary contacts to complete an electrical circuit;

an actuator having an electrically operated driver and a linkage coupling the electrically operated driver to the moveable contact for driving the movable contact into and out of engagement with the first and second stationary contacts; and an operator engaging the linkage and being manually operable to force the moveable contact away from engagement with the first and second stationary contacts in the event of contact welding.

18. The electric current switching apparatus as recited in claim 17 wherein the linkage of the actuator comprises:

a retainer slidably coupled to the body, and having an open end, a closed end and an aperture through which the moveable contact is received, with the electrically operated driver coupled to the retainer;

a first spring biasing the moveable contact with respect to the closed end of the retainer;

a plunger within the retainer on a side of the moveable contact remote from the close end, and having a portion which extends through an aperture in the moveable contact and abuts the closed end of the retainer;

a piston within the retainer and projecting from the open end; and a second spring biasing the plunger away from the piston.

19. The electric current switching apparatus as recited in claim 18 wherein the operator engages the piston and projects outward from the housing.

* * * * *